US005176522A

United States Patent [19]

Robertson, Jr.

[11] Patent Number: 5,176,522

[45] Date of Patent: Jan. 5, 1993

[54] ERASABLE MARKER BOARD ASSEMBLY

[76] Inventor: Charles D. Robertson, Jr., 45 White Oak La., Little Rock, Ark. 72207

[21] Appl. No.: 868,976

[22] Filed: Apr. 16, 1992

[51] Int. Cl.[5] ..... B43L 1/00; B43L 23/00

[52] U.S. Cl. ..... 434/415; 434/408; 434/421

[58] Field of Search ..... 434/408, 415, 417, 421, 434/422, 423; 40/159.1

[56] References Cited

U.S. PATENT DOCUMENTS

| | | | |
|---|---|---|---|
| 80,410 | 7/1868 | Heneage | 434/423 |
| 2,456,103 | 12/1948 | Amstutz | 434/408 |
| 2,679,700 | 6/1954 | Urbain | 434/417 |
| 3,432,944 | 3/1969 | Ishida | 434/417 |
| 3,965,601 | 6/1976 | Nielsen | 40/155 |
| 5,035,626 | 7/1991 | Persing | 434/408 |

FOREIGN PATENT DOCUMENTS

| | | | |
|---|---|---|---|
| 3356 | of 1883 | United Kingdom | 434/423 |

*Primary Examiner*—John J. Wilson
*Assistant Examiner*—Cindy A. Cherichetti
*Attorney, Agent, or Firm*—Stephen D. Carver

[57] ABSTRACT

A display device upon which erasable indicia may be written comprises a rigid frame encompassing a planar marking surface and corners joining elements of the frame. The frame comprises an elongated top spaced apart from a parallel, elongated bottom, and a pair of spaced apart sides extending perpendicularly between the top and the bottom. The sides and top are formed from a single continuous piece of aluminum extrusion having a generally J-shaped cross section. A similar extrusion forming the bottom comprises an added outwardly extending tray. The planar marking surface is preferably fiberboard, spray coated with polyurethane. Crimps defined in the frame secure the board. Each upper corner of the device is reinforced by a resilient, snap fit hanging bracket which is offset from the back of the board to engage a fastener. A pair of L-shaped modular corners join the frame sides to the bottom. Each corner comprises a base, a front, and a rear wall extending upwardly from the base forming a channel, an offset snap fitting system, and an end wall. An outwardly projecting ledge concurrently mates with an end of the bottom and its tray. The channel receives an end of one side. Its walls are notched to accommodate the J-shaped configuration of extrusions. The offset snap tabs are defined by the walls for captivating and mating with an end of one side. The closed end wall extends between the front and rear walls and the base.

19 Claims, 4 Drawing Sheets

ERASABLE MARKER BOARD ASSEMBLY

BACKGROUND OF THE INVENTION

The present invention broadly relates to display devices. More particularly, the invention relates to erasable marker boards of the type classified in U.S. Class 434, subclass 417 or U.S. Class 528, subclass 207.

In many instances conventional chalkboards have given way to plastic-coated boards upon which felt tip markers can be used. The latter boards are easily erased. Other advantages of these marker boards include relatively low weight and reduced production costs. In a classroom application, large sections of plastic-coated board can easily be hung in place of a conventional chalkboard. However, many instances call for a smaller board which can be quickly and easily impermanently mounted upon a wall. Furthermore, such a board needs to be somewhat portable. Therefore, the need for a unitary lightweight structurally sound marker board is evident. To create such a board a manufacturer will be required to frame the plastic marking surface.

Many frame elements are present in the prior art. Hutten U.S. Pat. No. 4,623,169 discloses an apparatus for clamping. This device is intended to clamp a pad of papers to an upright support. Hutten also discloses in U.S. Pat. No. 4,629,275 a mounting strip for clamping similar flexible sheet materials. That clamp is largely composed of a plastic channel with a gripper tongue disposed along an interior surface.

Champagne in U.S. Pat. No. 4,230,052 granted Oct. 28, 1980, discloses a corner support system for shelves. The system has triangular shaped elements to reinforce a corner of the shelving system. U.S. Pat. No. 4,747,248 granted May 31, 1988, to Fahs discloses a method for corner construction. This method comprises elaborate cuts in frame members to form the corner of an aluminum window or door.

Design Pat. No. 286,434 discloses a plastic window frame corner which has a plurality of intermittent walls and ridges to accommodate the relatively complex structure of an insulated window frame. Schiavello U.S. Pat. No. 4,852,317 speaks to a demountable panel system. The primary operative component of this invention is a bracket of relatively complex structure which employs clip rail sections to trap and hold a plurality of panels in a spaced apart relationship. Bucci U.S. Pat. No. 4,987,709 discloses a frame construction system. This system uses corner reinforcement members that employ wedges between two channels adapted to receive a pane of glass. Warner U.S. Pat. No. 4,064,644 speaks to a frame construction and corner clip apparatus. The frame is constructed of extruded metallic material having an "F" shaped cross-section and a corner bracket that is "L" shaped to join the ends of the "F" shaped material. The bracket has channels adapted to receive the "F" shaped material.

U.S. Pat. No. 4,662,092 discloses a picture frame construction. This patent primarily discloses a corner bracket that is intended to create a curved transition from one piece of an "F" shaped extruded frame material to another. Field U.S. Pat. No. 4,898,285 discloses a merchandise rack covering system. This system is comprised of semi-circular tubing intended to be disposed over the square members of a merchandise rake and corner brackets to join the semi-circular tube sections. Machler discloses in U.S. Pat. No. 4,502,260 corner fasteners. These corner fasteners are intended for use on window screens and employ a resilient finger of a hemispherical shape extending from the corner to facilitate securement within a window frame. Nielsen U.S. Pat. No. 3,965,601 discloses an "L" shaped corner bracket for insertion into the mitered corners of a picture frame extrusion. Paskerian U.S. Pat. No. 3,965,600 discloses a picture frame hanger. This hanger is a "U" shaped plate which may be slide into the channels of a conventional picture frame.

Some prior art suggests the use of a frame to surround a board intended to convey information. Seely U.S. Pat. No. 4,519,152 discloses a theft proof poster display device. This device is intended to have a pivoting front frame and is similar to conventional movie poster display systems. Weil U.S. Pat. No. 4,763,929 discloses an erasable marker system that is comprised of a bracket to hold layers of a material which may be marked upon. Furthermore, the system can remove one layer of the material and replace it with another. Coster U.S. Pat. No. 4,045,013 discloses a marker board which embodies a frame, an array of annular bar rings, and a plurality of flexible shells.

The prior art has also suggested mechanisms to ease the use of boards intended to convey messages. Robins U.S. Pat. No. 4,834,334 discloses a turn and tilt easel. The easel is pivotally attached to a base to allow the base to be set on a supportive surface such as a table. Stempel U.S. Pat. No. 4,437,839 discloses a chalkboard with a hinged chalk rail. This patent discloses a indicia receiving board with a longitudinally disposed folding rail. The rail may be folded up close to the writing surface of the board. Seregely U.S. Pat. No. 3,949,132 discloses marker boards and erasable ink compositions therefore. This patent discloses the ink composition for erasable marker boards and boards having smooth, nonporous surfaces to facilitate the use of the ink.

The prior art fails to disclose an erasable marker board with the aforementioned desirable characteristics, namely lightweight, structural strength and portability. Frame corners allowing two similar frame members to be structurally and stylishly joined are extensively disclosed in the prior art. Yet, the prior art does not disclose a corner bracket that will allow a transition from a frame material with a particular cross-section to a dissimilar framing material. Such a corner bracket would be necessary to form a smooth transition between the relatively flat and compact frame to the tray portion necessarily disposed along the lower edge of a marker board. This tray is desired to hold unused marker pens or the like. Furthermore, the previously employed board assemblies fail to disclose a lightweight, portable board which can be hung upon a wall. Finally, while some of the frames disclosed by the prior art allow for a unitary frame none is suitable to provide the desired lightweight, transportable marker board.

SUMMARY OF THE INVENTION

I have developed a marker board to meet the need for an erasable display device that is lightweight and portable. The marker board can be conveniently transported and adjusted, and it can be securely hung where desired. The modular nature of the new marker board provides a writing surface that is stable and has significant structural strength when hung upon a wall. The modular nature of the new marker board makes it readily usable for a variety of purposes.

The device is primarily composed of a frame encompassing a planar marking surface. To allow the frame to employ a tray along its bottom, a pair of corners are needed to provide a smooth transition. A relatively compact extrusion forms the frame's sides while an extrusion along the base forms the desired tray. Additionally, structural reinforcement to the other two corners of the device and the capacity to hang the device are desirous. Therefore, interchangeable hanging brackets are deployed in the frame's upper corners.

In the best mode, the generally rectangular frame has a top, two sides and a bottom. The top and sides are constructed from a continuous section of extruded aluminum stock having a J-shaped cross section. The bottom is also formed from extruded aluminum stock. However, the bottom stock, while having a similar J-shaped cross section portion, has an additional portion extending perpendicular to the legs of the "J." This additional portion forms a tray which terminates in an upturned lip.

The marking surface is preferably provided by a layer of polyurethane spray disposed on one side of a generally rectangular piece of fiberboard. However, alternative embodiments of this invention could replace the marking surface with a chalk board material, corkboard or another display material. The frame encompasses the board. Crimps in the frame secure it to the board. If the hanging brackets are not employed, these crimps secure a pair of spaced apart loops for hanging the device.

Preferably, each upper corner of the device is reinforced by a hanging bracket. The hanging modular brackets are interchangeable, and preferably molded from plastic. These brackets snap fit around the frame and provide an offset square flange with rounded corners defining an L-shaped aperture. The offset prevents a nail or the like passing through the flange from contacting the board as it emerges from the flange.

Alternatively, hanger loops are disposed between the frame and the board. These hanger loops are bent upward thereby hooking the short leg of the "J" shaped extrusion and creating a way to hang the marker board.

A pair of L-shaped modular corners snap fit to the frame sides and slip on to the end of the frame bottom. Each corner comprises a base, a front wall, a rear wall. The walls extend upward from the base forming a channel. An offset snap fitting system, and an end wall are also present in each corner. The base forms an outwardly projecting ledge adapted to concurrently mate with an end of the bottom and its tray.

Modular, mirror image corner brackets join the lower extremes of the frame sides to the frame bottom. Such brackets are necessitated by the dissimilar cross-sectional shapes of the sides of the frame and the bottom. In other words, the brackets avoid sharp corners, and provide a smooth transition from the sides to the stock, while forming the bottom and its tray.

The brackets are generally "L" shaped in cross section. Each bracket comprises a base, a front wall, a rear wall, off-set snap tabs, and a closed end. The base of the bracket is adapted to mate with the bottom of the frame. The base also has an outwardly projecting ledge adapted to mate with the tray formed by the extruded stock of the frame bottom. The front and rear walls extend upward from the base, forming a channel. The channel receives the lower extreme of a side of the frame and an end of the bottom of the frame joining them. The off-set snap tabs are disposed on the vertical edges of the front and rear walls. These tabs "snap" around the edges of the extruded stock. The closed end spans the distance between the walls and the base.

The marker board is a modular unit having no sharp corners. Meanwhile, the corner brackets cooperate with the other components inducing each component to synergistically strengthen the entire assembly. The modular nature of the device provides a writing surface readily usable for a variety of purposes. When hung upon a wall, the device is stable and has significant structural strength.

Therefore, a primary object of the present invention is to provide an erasable marker board device which is unitary in nature and may be easily and reliably hung upon a wall.

Another object of the present invention is to provide an erasable marker board device with significant structural strength.

Another object of the present invention is to provide a frame and bracket assembly which is capable of supporting and enclosing a variety of relatively planar writing or marking surfaces.

A related object of the present invention is to provide a frame for an erasable marker board of which will protect the edges of the board.

A significant object of the present invention is to provide an erasable marker board which is relatively portable.

An object of the present invention is to provide a marker board which may be erased using a dry towel, rag, or conventional chalkboard eraser.

An object of the present invention is to provide a marker board with smooth corners, avoiding any sharp edges.

A related object of this disclosure is to provide an esthetically pleasing erasable marker board.

Another object of the present invention is to disclose a unitary marker board that will facilitate the convenient placement of writing instruments.

An object of the present invention is to provide a marker board which may be easily hung upon a wall in a variety of locations.

Another object of the present invention is to provide a marker board which is easily used and reused.

These and other objects and advantages of the present invention, along with features of novelty appurtenant thereto, will appear or become apparent in the course of the following descriptive sections.

BRIEF DESCRIPTION OF THE DRAWINGS

In the following drawings, which form apart of the specification and which are to be construed in conjunction therewith, and in which like reference numerals have been employed throughout wherever possible to indicate like parts in the various views.

DETAILED DESCRIPTION

Figure 1:
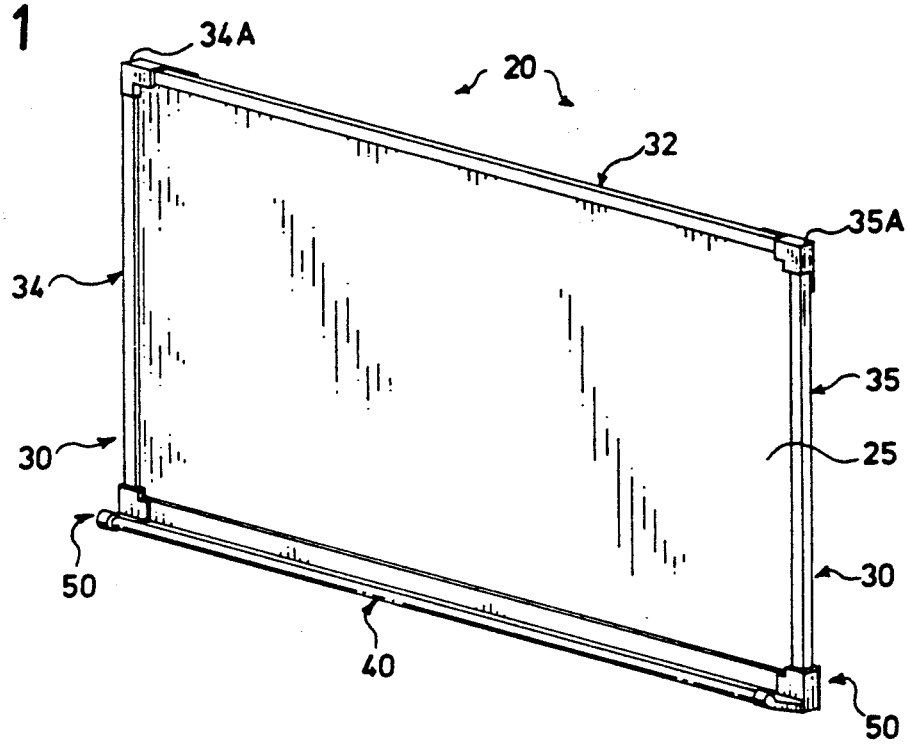
FIG. 1 is frontal isometric view of the best mode of Erasable Marker Board Assembly.

Turning now to the drawings, the best mode of my erasable marker board device is broadly designated by the reference numeral 20. The primary components of the device 20 are a frame 30, a planar marking surface 25 and right and left corners 50 joining the elements of the frame 30.

Figure 2:
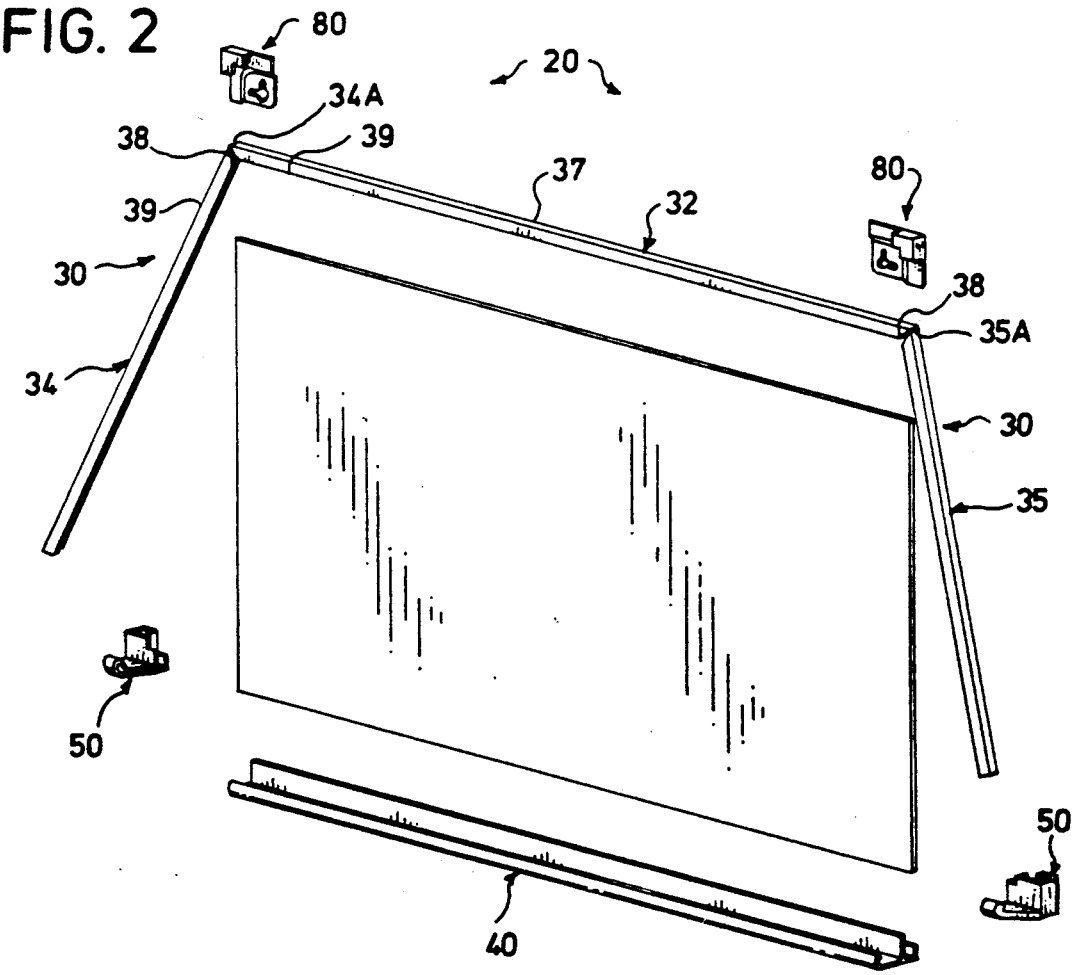
FIG. 2 is an exploded isometric view thereof.

As can be appreciated from FIGS. 1 and 2, the modular nature of the disclosed marker board device 20 provides a writing surface 25 readily usable for a variety of purposes. When hung upon a wall the device 20 is stable and has significant structural strength.

Figure 8:
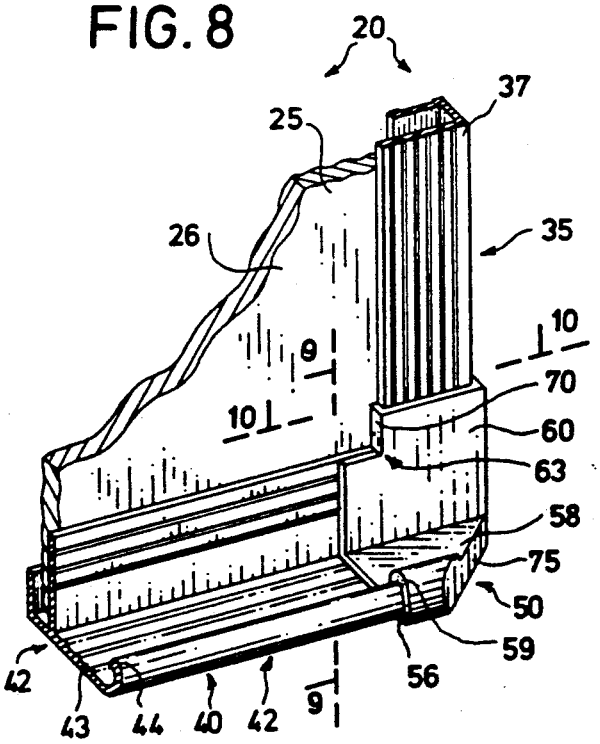
FIG. 8 is a fragmentary, frontal isometric view of the preferred bottom corner construction.

The marking surface 25 is a layer of polyurethane spray disposed on one side of a generally rectangular piece of fiberboard 26 (FIG. 8). However, an alternative embodiment would replace the marking surface 25 with a chalk board material or the like. Additionally cork-board or other such material could also be employed on the exposed surface 25 of the marker board device 20.

Figure 10:
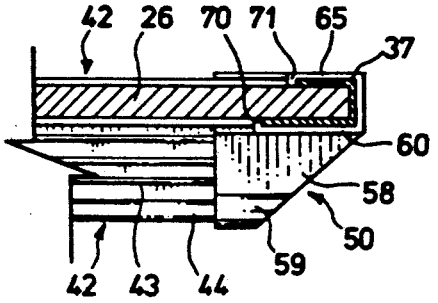
FIG. 10 is a fragmentary, partially elevational and partially cross-sectional view taken generally along line 10—10 of FIG. 8.
Figure 11:
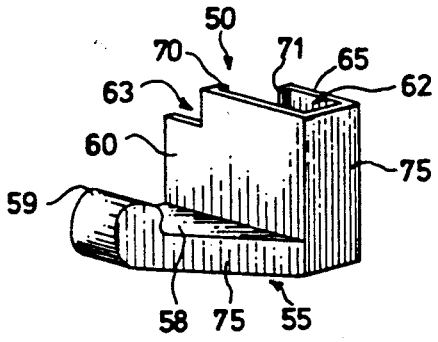
FIG. 11 is an outside, frontal isometric view of a preferred corner.
Figure 12:
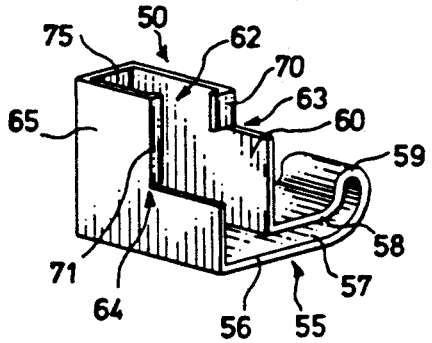
FIG. 12 is an inside, rear isometric view of a preferred corner.
Figure 13:
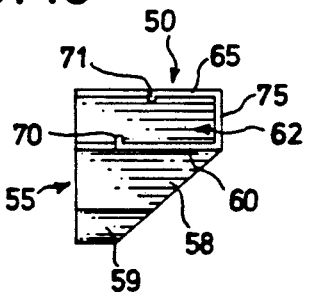
FIG. 13 is top elevational view of the preferred corner.
Figure 14:
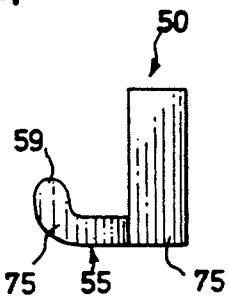
FIG. 14 is an outside elevational view of the preferred corner.
Figure 15:
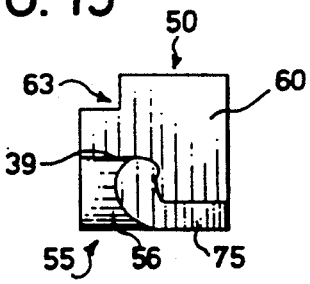
FIG. 15 is a front elevational view of the preferred corner.
Figure 16:
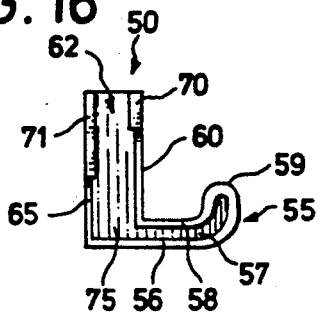
FIG. 16 is an inside elevational view of the preferred corner.
Figure 17:
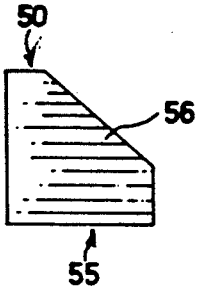
FIG. 17 is bottom elevational view of the preferred corner.

In the best mode the frame 30 describes the general outline of a rectangle having a top 32, two sides 34 and 35 and a bottom 40. Four vertices are formed at corners of the rectangle. The top 32 and sides 34 and 35 are constructed from a continuous section of extruded "J" shaped aluminum stock 37. The "J" shape cross section is best illustrated in FIG. 10. To form the top 32 and sides 34 and 35 of the frame 30 from a single piece of aluminum stock 37, two right angle notches 38 are cut into the stock 37. These notches are set at forty-five degree angles relative to the edges 39 of the stock 37 thereby, allowing the portions of the stock 37 to be folded at 34A and 35A (FIG. 2).

Figure 9:
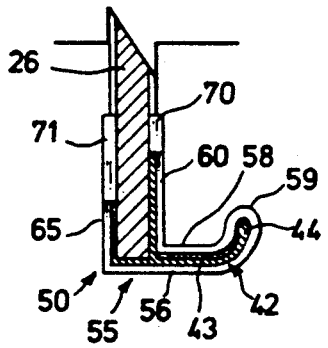
FIG. 9 is a fragmentary, partially elevational and partially cross-sectional view taken generally along line 9—9 of FIG. 8, illustrating a corner in an assembled position.

The bottom 40 is also formed from extruded aluminum stock 42, cross sectionally illustrated in FIG. 9. However, this stock 42, while having a similar "J" shaped cross section portion, has an additional portion extending perpendicular to the legs of the "J" and the surface 25 of the device 20. This portion forms a tray 43 for the placement of writing instruments when not in use on the board. This tray 43 has an upturned lip 44.

Figure 3:
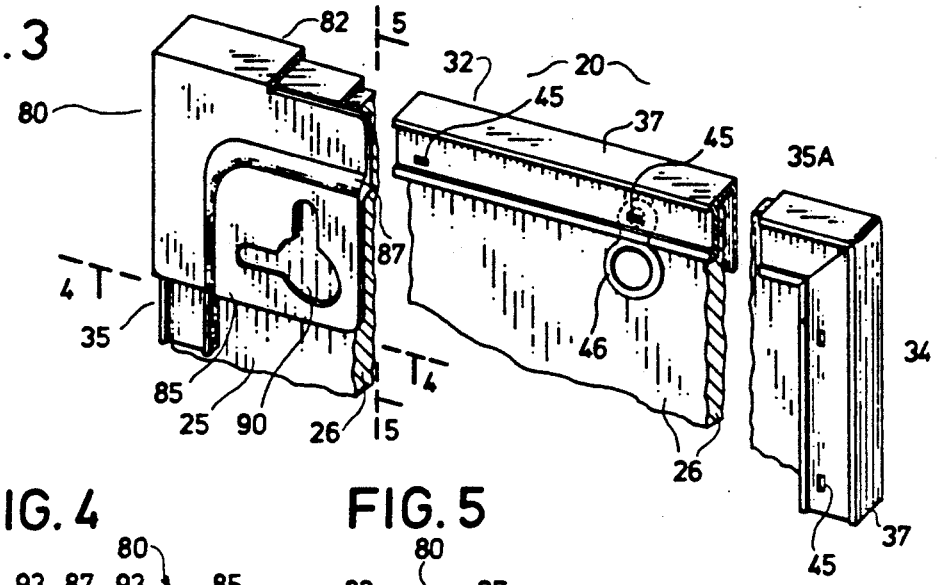
FIG. 3 is a enlarged, fragmentary isometric view showing upper, rear corner portions of the assembly.
Figure 4:
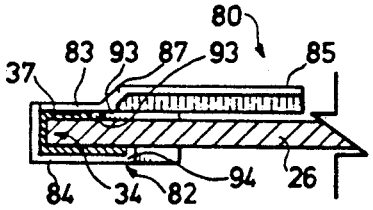
FIG. 4 is a fragmentary sectional view taken generally along line 4—4 of FIG. 3, with portions thereof omitted for clarity.
Figure 5:
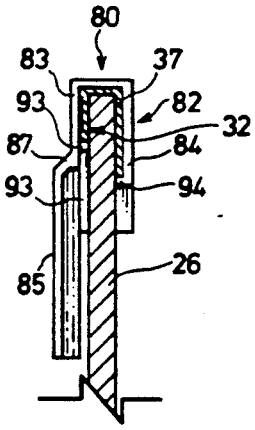
FIG. 5 is a fragmentary sectional view taken generally along line 5—5 of FIG. 3, with portions thereof omitted for clarity.
Figure 4A:
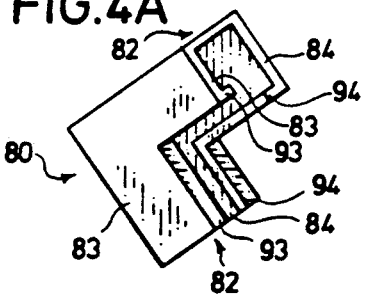
FIG. 4A is a fragmentary oblique view of the hanger bracket, with portions omitted for clarity.
Figure 6:
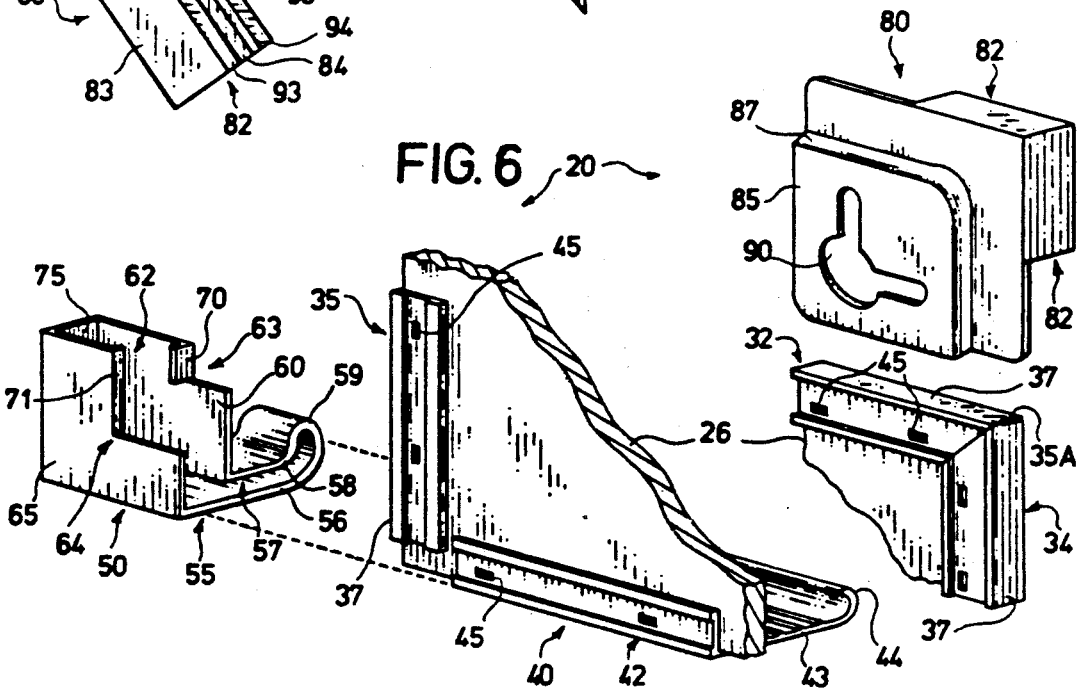
FIG. 6 is a fragmentary, exploded rear isometric view showing preferred corner assemblies, with portions omitted for clarity or brevity.
Figure 7:
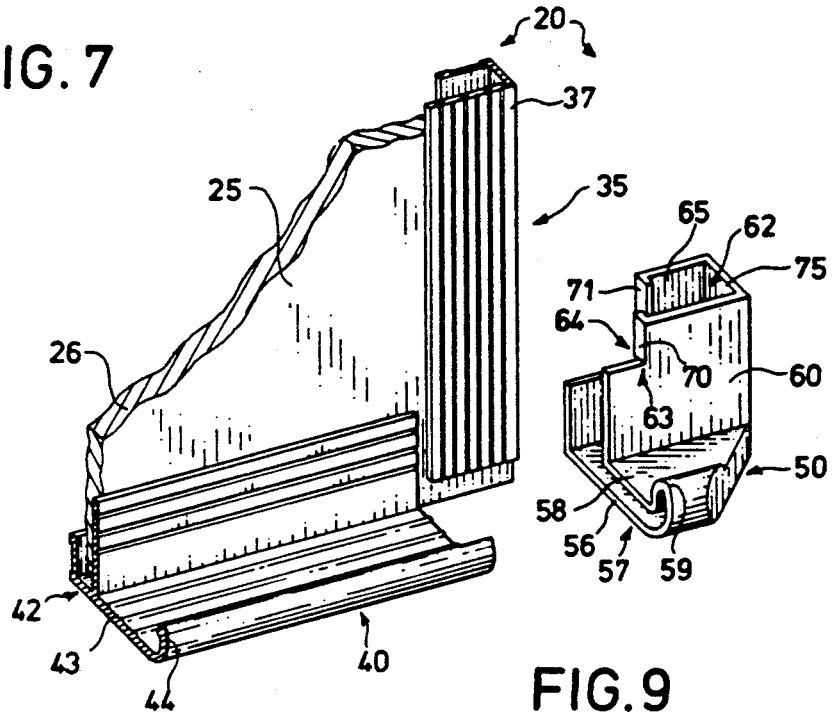
FIG. 7 is a fragmentary, exploded frontal isometric view of the preferred bottom corner construction.

Turning to FIGS. 2, 3 and 6 the frame 30 is slipped around the board. The longer leg of the extruded stock 37 and 42 is disposed adjacent to the finished surface 25 of the board. The stock 37 or 42 is secured into place by crimps 45 pressed into the frame 30 along the shorter leg of the "J" shaped extruded stock 37 and 42 (FIGS. 3 and 6).

In the preferred embodiment each upper corner of the device is reinforced by a hanging bracket 80. The hanging brackets 80 provide an aperture 90 by which the device 20 may be hung. The hanging brackets 80 are interchangeable, modular and molded from plastic. These brackets 80 have two J-shaped channel sections 82 disposed at right angles to one another. The channel is of the dimensions necessary to encompass the stock 37 forming the sides 34 and 35 and top 32 of the frame 30. Each leg 83 and 84 of the channel has a tab 93 and 94 disposed along its edge. The tabs 93 and 94 snap fit around the legs of the J-shaped stock 37 that forms the sides 34 and 35 and top 32 of the frame 30. Therefore, the tabs 93 and 94 secure the hanging bracket 80 in an upper corner 34A or 35A of the frame. A generally square flange 85 with rounded corners defines an L-shaped aperture 90. The flange 85 is joined to the channels 82 by a shoulder 87 that offsets the flange 85 from the channels 82. Installed, the flange 85 is also offset from the back of the board 26. Hence, a nail or the like passing through the aperture 90 does not contact the board 26 as it emerges from the flange 85.

Alternatively, hanger loops 46 formed of sheet metal are disposed between the frame 30 and the board at two or more of the crimps 45. These hanger loops 46 are bent upward thereby hooking the short leg of the "J" shaped extrusion and creating a medium to hang the marker board (FIG. 3).

Modular corners 50 join the lower extremes of the frame sides 34 and 35 to the frame bottom 40. The corners 50 are necessitated by the dissimilar cross-sectional shapes of the sides 34 and 35 of the frame 30 and the frame bottom 40. In other words, since the sides 34 and 35 and the bottom 40 are made of different stock 37 and 42 respectively, a mechanism is required to create a smooth transition between the sides 34 and 35 and the bottom 40.

The corners 50 are generally a mirror image of one another. Therefore, the description below will disclose only one corner 50 in detail. Any reference to right or left will be avoided.

Each corner 50 is generally "L" shaped in cross section, as seen in FIGS. 9–17. Corner 50 comprises a base 55, a front wall 60, a rear wall 65, a pair of off-set snap tabs 70 and 71, and a closed end 75. The base 55 of the corner 50 is adapted to mate with the bottom 40 of the frame 30. This base 55 also has an outwardly projecting ledge 57 designed to receive the frame bottom 40. The ledge 57 curves upward, remote from the rear wall 65. Ledge 57 is adapted to mate with the tray 43 formed by the extruded stock 42 of the frame bottom 40. The ledge is formed by a foundation 56 extending perpendicularly outward relative to the rear wall 60 and a floor 58 extending perpendicularly outward from the front wall 65. The foundation 56 and floor 58 curve upward remote from the walls 60 and 65 to join, forming a curb 59.

The front and rear walls 60 and 65 extend upward from the base 55 in a spaced apart relationship. In conjunction with the base 55 and the closed end 75, the walls form a channel 62. The channel 62 receives the lower extreme of the side 34 or 35 of the frame 30 and the end of the bottom 40 of the frame 30 to join them. Further, the walls 60 and 65 have notches 63 and 64 respectively to follow the descending side 34 or 35 and the horizontal edge of the bottom 40.

The pair of off-set snap tabs 70 and 71 are disposed on the vertical edges of the front and rear wall 60 and 65 notches 63 and 64. These tabs 70 and 71 "snap" around the edges of the extruded stock 37 forming the side 34 or 35.

The elements of the modular corner 50 are joined by the closed end 75 that spans the distance between the walls 60 and 65 and the base 55.

Therefore, the disclosed device 20 forms a modular unit that has no sharp edges. Furthermore, the corners 50 unite the components of the marker board device 30, causing each component to lend strength to the other components.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A display device upon which erasable indicia or messages may be written, said device comprising:

a rigid frame for suspending said device upon a wall or the like, said frame comprising an elongated top spaced apart from a parallel, elongated bottom, and a pair of spaced apart sides extending perpendicularly between said top and said bottom, said bottom comprising an outwardly extending tray;

a planar marking surface bounded by said frame; and, resilient corners for joining said sides to said base, said corners having a generally a L-shaped cross section and comprising:

a base adapted to mate with an end of said bottom, said base forming an outwardly projecting ledge adapted to concurrently mate with ends of said tray;

integral, spaced apart front and rear walls extending upwardly from said base, said walls forming a channel adapted to receive an end of one side; and, offset snap means defined by said walls for captivating an end of one side.

2. The device as defined in claim 1 wherein:

said top and said sides comprise extrusions having a generally J-shaped cross section forming a channel for press fitting to said surface; and, wherein said last mentioned J-shaped extrusion mates within said offset snap fit means.

3. The device as defined in claim 2 wherein said bottom comprises an extrusion having a portion with a generally J-shaped cross section forming a channel for press fitting to said surface, said last mentioned portion integral with said tray.

4. The device as defined in claim 3 wherein said tray curves upwardly and outwardly to form a lip, said tray and lip being perpendicular to said surface.

5. The device as defined in claim 4 wherein said walls are notched to accommodate the J-shaped configuration of said bottom portion and said sides.

6. The device as defined in claim 5 wherein said surface comprises a fiber board spray coated with polyurethane.

7. The device as defined in claim 6 wherein said frame further comprises crimps to secure said frame to said board.

8. The device as defined in claim 6 wherein said frame further comprises a pair of spaced apart loop means for hanging said device, said loop means secured to said device by one of said crimps.

9. The device as defined in claim 8 wherein said sides and said top comprise a single continuous piece of said extrusion and notches are defined in said extrusion to facilitate folding of said sides relative to said top.

10. The device as defined in claim 1 further comprising a pair of hanging brackets adapted to be fitted to upper corners of said frame for reinforcing the frame and establishing a hanging point.

11. A display device upon which erasable indicia or messages may be written, said device comprising:

a planar writing surface;

a rigid frame surrounding said surface for suspending said device upon a wall or the like, said frame comprising:

an elongated top spaced apart from a parallel, elongated bottom;

a pair of spaced apart sides extending perpendicularly between said top and said bottom;

upper and lower corners formed at vertices of said frame;

said top and said sides comprising a single continuous piece of extrusion having a generally J-shaped cross section forming a channel for press fitting to said board;

said bottom comprising an extrusion having a portion with a generally J-shaped cross section forming a channel for press fitting to said surface, said portion integral with an outwardly extending tray;

right and left modular corners for joining said sides to said base, said corners having a generally L-shaped cross section, the corners comprising:

a base adapted to mate with an end of said bottom, said base forming an outwardly projecting ledge adapted to concurrently mate with an end of said tray;

integral, spaced apart front and rear walls extending upwardly from said base, said walls forming a channel adapted to receive an end of one side, said walls notched to accommodate the J-shaped configuration of said bottom portion and said sides;

offset snap means defined by said walls for captivating an end of one side and mating with said J-shaped extrusion; and, hanging brackets adapted to be fitted to upper corners of said frame for captivating and reinforcing at least a portion of said frame and for establishing a hanging point for said device.

12. The device as defined in claim 11 wherein said hanging brackets comprise offset snap means for mating with said J-shaped portions of said frame.

13. The device as defined in claim 12 wherein said hanging brackets comprise offset apertured surfaces facilitating hanging of said device.

14. The device as defined in claim 12 wherein said tray curves upwardly and outwardly to form a lip, said tray and lip being perpendicular to said surface.

15. The device as defined in claim 14 wherein said surface comprises a fiber board spray coated with polyurethane.

16. The device as defined in claim 15 wherein said frame further comprises crimps to secure said frame to said board.

17. The device as defined in claim 15 wherein said frame further comprises a pair of spaced apart loop means for hanging said device, said loop means secured to said device by one of said crimps.

18. A display device for hanging upon a wall or the like upon which erasable indicia or messages may be written, said device comprising:

a rigid extruded frame for suspending said device upon a wall or the like, said frame comprising an elongated top spaced apart from a parallel, elongated bottom, and a pair of spaced apart sides extending perpendicularly between said top and said bottom, said bottom comprising an outwardly extending tray and said frame defining upper and lower vertices;

a planar marking surface bounded by said frame;

said top, said sides, and said bottom comprising a generally J-shaped cross section forming a channel for press fitting to said surface;

resilient corners for joining said sides to said base, said corners having a generally a L-shaped cross section and comprising:

a base adapted to mate with an end of said bottom, said base forming an outwardly projecting ledge adapted to concurrently mate with ends of said tray;

integral, spaced apart front and rear walls extending upwardly from said base, said walls forming a channel adapted to receive an end of one side; and, offset snap means defined by said walls for captivating an end of one side and, wherein said last mentioned J-shaped extrusion mates within said offset snap fit means; and, a pair of upper hanging brackets adapted to be fitted to upper vertices of said frame for reinforcing the frame and establishing a hanging point.

19. The device as defined in claim 18 wherein said hanging brackets comprise offset snap means for mating with said J-shaped portions of said frame and offset apertured surfaces facilitating hanging of said device.

* * * * *